United States Patent [19]

Kiraly et al.

[11] 4,173,285

[45] Nov. 6, 1979

[54] DISPENSER FOR BONDED RAZOR BLADE CARTRIDGES

[75] Inventors: Ernest F. Kiraly, Fairfield, Conn.; Vincent C. Motta, Bronx, N.Y.

[73] Assignee: Warner-Lambert Company, Morris Plains, N.J.

[21] Appl. No.: 929,484

[22] Filed: Jul. 31, 1978

[51] Int. Cl.[2] ..... B65D 7/00; B65D 57/00; B65D 85/62

[52] U.S. Cl. ..... 206/356; 206/359; 30/40.2

[58] Field of Search ..... 206/356, 354, 355, 359; 221/102; 30/40.2, 34 R, 30, 32–42

[56] References Cited

U.S. PATENT DOCUMENTS

| | | | |
|---|---|---|---|
| 3,771,223 | 11/1973 | Dawidowicz et al. | 206/354 X |
| 3,797,657 | 3/1974 | Petrillo | 206/356 |
| 3,835,532 | 9/1974 | Petrillo | 206/356 X |
| 3,854,201 | 12/1974 | Dawidowicz et al. | 30/40.2 |

*Primary Examiner*—George T. Hall

*Attorney, Agent, or Firm*—Jeremiah J. Duggan; Stephen A. Schneeberger

[57] ABSTRACT

A dispenser having a plurality of row-arrayed compartments each for releasably retaining a razor blade cartridge therewithin. The opposite ends of the compartments are respectively formed by a partition wall and yieldable, free-standing retention means positioned such that the end of one compartment is not in common with the opposite end of the next compartment, thereby making the compartments independent of one another to minimize the cumulative effects of oversize cartridge tolerances. The free-standing fingers also reduce the force required to manually load cartridges into the dispenser during assembly.

11 Claims, 12 Drawing Figures

DISPENSER FOR BONDED RAZOR BLADE CARTRIDGES

BACKGROUND OF THE INVENTION

1. Field of the Invention

The present invention relates to razor blade dispensers and more particularly to dispensers for bonded razor blade cartridges.

2. Description of the Prior Art

It is known to permanently bond one or more blades having single edges in a disposable cartridge. An example of a twin blade bonded cartridge is disclosed in U.S. Pat. No. 3,785,051. An advantage of a blade permanently bonded in a cartridge is that it is possible to optimize the shaving angle defined by the relationship between the cutting edge and the guard surface to minimize the possibility of nicks and cuts to maximize shaving efficiency.

Such bonded razor blade cartridges are usually stored in and dispensed from any of several types of cartridge dispensers, examples of the most common types of which are illustrated in the aforementioned U.S. Pat. No. 3,785,051 and additionally in U.S. Pat. No. 3,835,532. The dispensers of those patents provide a series of generally rectangular open-top chambers disposed in a row, most of the chambers each storing a respective one of the bonded razor cartridges. The several open-top chambers or compartments row-aligned in the dispenser have typically been formed and defined by extending a series of parallel spaced partition walls from one side wall of the dispenser to the other to form the compartment end walls. Those dispenser side walls comprise the side wall portions of a normally rectangular peripheral wall upstanding from the base of the dispenser. The outermost compartment end walls are defined by the respective opposite ends of the dispenser peripheral wall. A recess in one side wall portion of each of the respective chambers has permitted ingress and egress of a channel member on a razor handle for coupling and uncoupling connection respectively with the cartridge therein.

One or more retention latches has been provided in each of the cartridge chambers for securely retaining a cartridge therewithin during handling and storage and being sufficiently resilient to permit insertion or removal of the cartridge therefrom when the appropriate inserting or removing forces respectively are applied thereto. The retention latch or latches in each compartment have normally been formed on the partition walls extending across the dispenser, with the oppositely-disposed continuous partition walls defining the opposite ends of the chamber and the retention latches simply retaining the cartridge in the chamber.

While the foregoing dispenser configuration has generally been succesful, the manual loading of cartridges into the dispenser at the time of manufacture, as by forcing them down past the retention latches, has generally required a significant manual force by the person loading them. Moreover, the accumulated tolerances of several overly large cartridges may cause difficulty in loading and unloading the cartridges, particularly where each cartridge is normally in end-to-end engagement with the opposite partition walls defining the end walls of a compartment. Still further, a recent improvement in bonded razor cartridges to include a manually displaceable clean-out mechanism has complicated the housing of such razor cartridges in a conventional dispenser in a conventional manner inasmuch as care should be taken to avoid applying forces to the clean-out mechanism, as from a partition wall, during storage.

Accordingly, it is a principal object of the present invention to provide an improved dispenser for bonded razor blade cartridges arrayed in a row therewithin.

It is a further object of the invention to provide a multi-compartment dispenser for bonded razor cartridges in which the adverse effects of cumulative oversize tolerance errors in the cartridges is minimized.

SUMMARY OF THE INVENTION

In accordance with an aspect of the present invention, there is provided a dispenser for a plurality of disposable razor blade cartridges arrayed in a row, the cartridges being normally housed in the dispenser so as to expose coupling or connecting means thereon for connecting engagement with a razor handle for removal from the dispenser. The dispenser is preferably of one-piece construction and includes a generally rectangular base portion having a peripheral wall upstanding therefrom. A plurality of partition walls within the peripheral wall and upstanding from the base are disposed parallel to and spaced from one another and substantially parallel to portions of the peripheral wall to each define one respective end of a respective series of generally rectangular open-top compartments disposed in a row. The other end of each compartment is defined by respective substantially free-standing yieldable retention means upstanding from the base. The side walls of the respective compartments are defined by portions of the peripheral wall. A cartridge is retained in a respective open-top compartment by respective retention means acting in cooperation with a respective partition wall in opposed relation therewith.

The retention means which defines one end of each cartridge compartment is one or a plurality of free-standing fingers mounted in cantilever fashion to the base. The partition wall defining the end of the next adjacent compartment is separate from such retention fingers. In some embodiments of the invention, each partition wall is configured to permit a portion of the next preceding razor blade cartridge to extend partially therethrough or thereover, thereby preventing interference with a movable member associated with that portion of the cartridge.

DESCRIPTION OF SPECIFIC EMBODIMENTS

Figure 1:
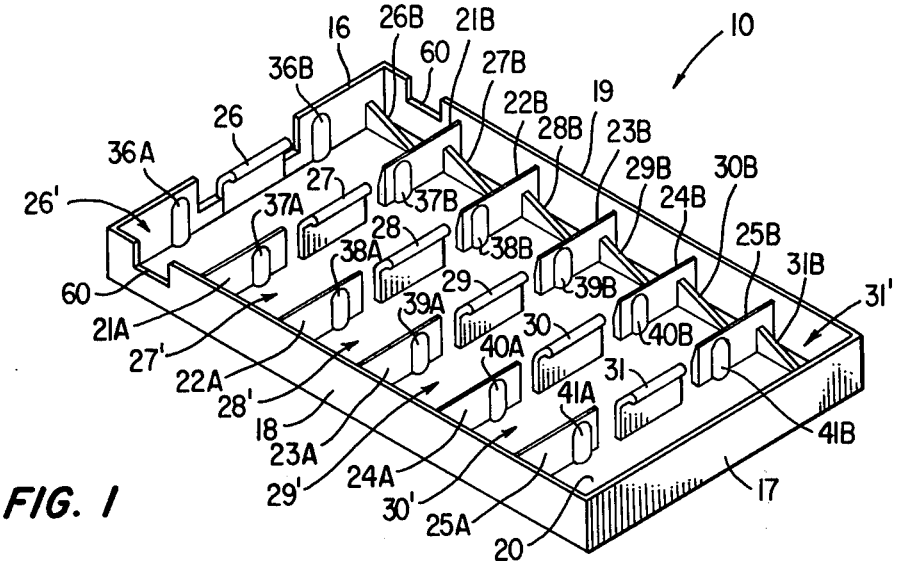
FIG. 1 is a perspective view of a dispenser in accordance with one embodiment of the invention.
Figure 2:
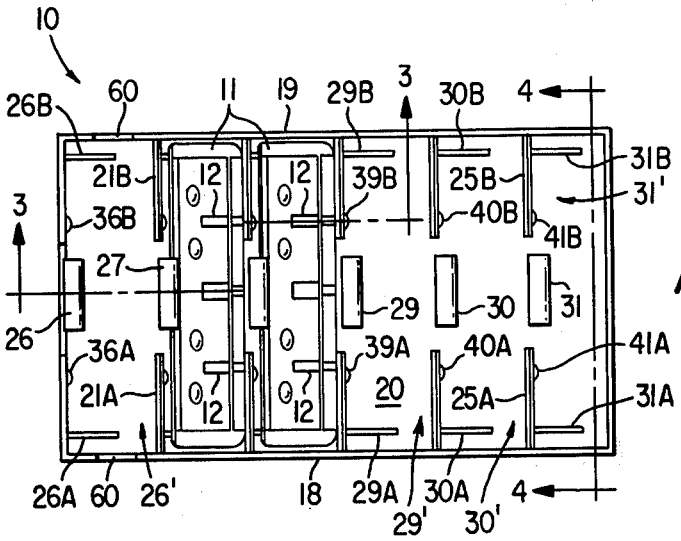
FIG. 2 is a top plan view of the dispenser of FIG. 1 showing blade cartridges therein.
Figure 3:
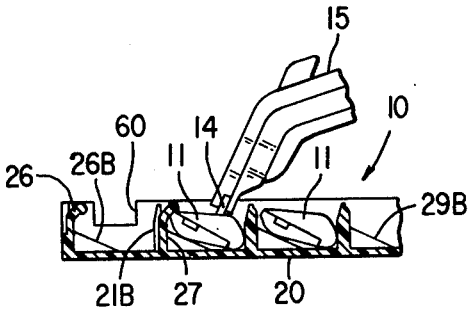
FIG. 3 is an elevational sectional view of a portion of the dispenser of FIG. 2 taken along line 3—3 thereof.
Figure 4:
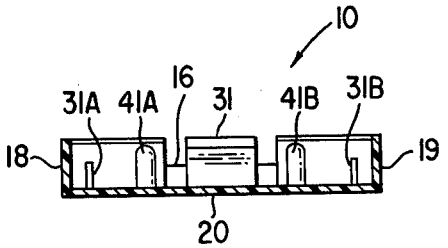
FIG. 4 is an elevational sectional view of the dispenser of FIG. 2 taken along line 4—4 thereof.
Figure 5:
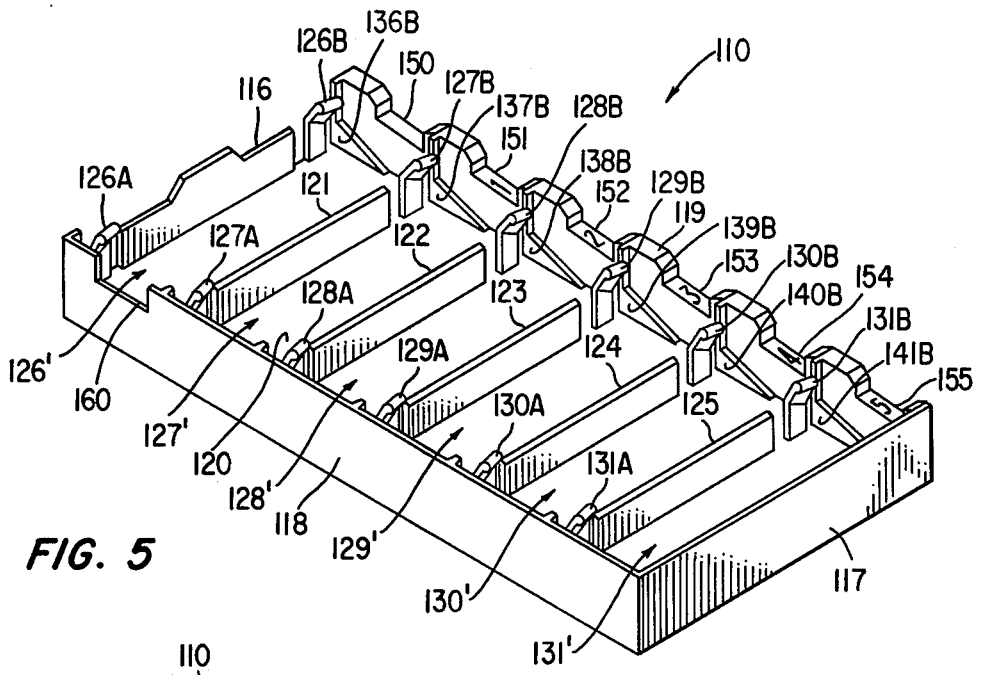
FIG. 5 is a perspective view of a dispenser in accordance with another embodiment of the invention.
Figure 6:
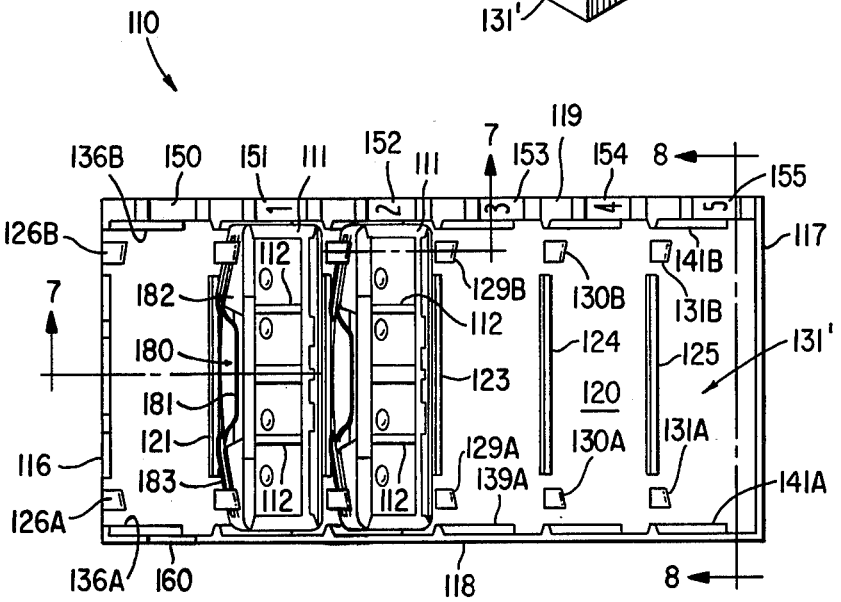
FIG. 6 is a top plan view of the dispenser of FIG. 5 showing blade cartridges therein.

FIGS. 1–4 show a dispenser 10 in accordance with one embodiment of the invention. Dispenser 10 is suitable for storing used and dispensing unused cartridges 11, only two of which appear in the drawings. While dispenser 10 is suited for use with a variety of bonded razor blade cartridges, the cartridge 11 illustrated herein is of a pivoting type similar to that disclosed in greater detail in U.S. Pat. No. 4,026,016, incorporated herein by reference. Cartridge 11 includes in its undersurface, upwardly exposed when housed in dispenser 10, a spaced pair of journal bearings 12 for pivoting engagement, as by journals 14 on razor handle 15 illustrated in FIG. 3, which razor handle may be of the same general type disclosed in the aforementioned U.S. Pat. No. 4,026,016.

The dispenser 10 is a one-piece molded structure of a suitable plastic such as high impact polystyrene including a pair of opposing end walls 16, 17 and a pair of opposing side walls 18, 19, all of which are upstanding from a base 20. The side and end walls 16–19 are joined at their ends in rectangular configuration and together comprise a peripheral wall for base 20, also of rectangular shape in plan view. Also forming an integral part of dispenser 10 are transverse partition walls 21A, 21B–25A, 25B upstanding from base 20, and retention fingers 26 and 27–31 also upstanding from base 20. The transverse partition walls 21A, 21B–25A, 25B and the retention fingers 26–31, as well as end walls 16 and 17, serve to form a series of six chambers or compartments 26′–31′. Orientation and feeding of the dispenser 10 preparatory to the loading of cartridges thereinto is facilitated by opposite notches 60 in side walls 18, 19.

More specifically, in accordance with the invention, each compartment is defined by a transverse wall at one end and a retention finger at the other end. Specifically, compartment 31′ is defined by end wall 17 and retention finger 31; compartment 30′ is defined by partition wall 25A, 25B and retention finger 30; compartment 29′ is defined by partition wall 24A, 24B and retention finger 29; compartment 28′ is defined by partition wall 23A, 23B and retention finger 28; compartment 27′ is defined by partition wall 22A, 22B and retention finger 27; and compartment 26′ is defined by partition wall 21A, 21B and retention finger 26. The sides of the respective compartment 26′–31′ are defined by portions of the dispenser side walls 18, 19.

The fact that only one end of each compartment is defined by a partition wall and the other end is defined by a retention finger is central to the present invention. A close inspection of FIGS. 2 and 3 as well as the detailed description to follow will reveal that the several retention fingers are positioned relative to the several partition walls such that one end, i.e., the guard end, of a cartridge 11 may longitudinally contact a partition wall, i.e., 22A, 22B, while the opposite end of the cartridge may not normally contact the next partition wall, i.e., 21A, 21B, but rather may contact and is longitudinally and vertically retained in compartment 27′ only by retention finger 27.

The transverse partition wall associated with each compartment is comprised of two segments, i.e., 21A, 21B, each segment being connected to an opposite side wall 18 or 19 and extending perpendicularly thereto about one-third the distance to the opposite wall. Each of these partition wall segments provides a substantially rigid member upstanding from base 20. Typically, a partition wall segment may have a root width of 0.040 inch which remains substantially constant over the lower half of its height, that thickness decreasing to slightly less than half that value at the top of the segment. The decreasing thickness of the upper portion of the partition wall segment is obtained by inclining that surface thereof facing the interior of a respective compartment such that a camming surface results which does not overstress the retention finger.

A pair of cartridge support ramps, i.e., 27A, 27B, for vertically supporting and orienting a cartridge 11 housed in the respective compartment, i.e., 27′, are formed on the respective partition wall segments, i.e., 21A, 21B, of the next adjacent compartment, i.e., 26′. The cartridge support ramps 26A, 26B–31A, 31B are connected directly to base 20 and a respective partition wall segment and are shown here as being spaced slightly from the respective side wall 18 or 19 of the dispenser. It will be appreciated, however, that the support ramps might also have been connected directly to the respective side walls 18, 19.

Each of the retention fingers 26–31 of the FIGS. 1–4, embodiment is a relatively thin projection upstanding from base 20 and having a front-to-rear thickness of about 0.030–0.035 inch over most of its length and a transverse width of about 0.375 inch. The junction of the retention fingers with base 20 is through radii sufficient to minimize stress concentration and thus permit flexing or yielding within desired limits without breaking. The width of retention fingers 26–31 is sufficiently narrow that each is spaced to the side of the respective partition wall segments proximate thereto, thereby making the fingers free-standing except for their direct connection with base 20. While retention finger 26 does have some connection with end wall 16, that connection is limited and the importance thereof for that particular retention finger is diminished inasmuch as a blade cartridge is normally not loaded into compartment 26′ at the time of manufacture.

The relatively thin front-to-rear dimensioning of retention fingers 26–31, coupled with ample radii at their respective junctions with base 20, provides elements capable of yieldably deflecting without breaking in response to deflection forces applied longitudinally of dispenser 10. Each retention finger includes a first lower portion extending vertically from base 20 to about two-thirds the height of the walls of dispenser 20, or 0.175 inch, and a second portion extending upwardly another 0.080 inch from the first portion and angled inwardly to the compartment which it defines. More specifically, the compartment-facing inner surface of the second portion of a retention finger includes a first surface inclined inwardly about 35° to the vertical and a terminal surface being inclined about 80° from the vertical, or nearly horizontal. This terminal surface is particularly suited for vertically capturing a cartridge within a respective compartment, as illustrated in compartment 27′ in FIG. 3. The force required for manufacturing personnel to manually place cartridges 11 in respective compartments of the dispenser is on the order of two pounds, that force being significantly less than the three and a half-four pounds experienced in dispensers of other designs in which the retention means are not free-standing but comprise part of a partition wall.

Further, each free-standing retention finger 26–31 is positioned longitudinally of dispenser 10 somewhat more inwardly of the respective compartment which it defines than the partition wall proximate thereto which defines one end of the next adjacent compartment. For instance, retention finger 27 is positioned relatively more inward of compartment 27' than partition wall segments 21A, 21B forming the end wall of the next adjacent compartment 26'. In this way, the inner surface of retention finger 27 defines an end of compartment 27' such that a cartridge 11 housed therein is normally not in contact with partition wall segments 21A, 21B. In fact, stop elements 37A, 37B–41A, 41B are integrally formed on those surfaces of partition wall segments 21A, 21B–25A, 25B respectively facing the compartments 27'–31' respectively.

Additionally, stop elements 36A and 36B are integrally formed on dispenser end wall 16 on the surface thereof facing compartment 26'. These stop elements are vertically extending arcuate ridges upstanding from the base 20. Stop elements 36A, 36B–41A, 41B extend arcuately outward from respective partition wall segments a distance of about 0.016 inch. This dimensioning is such that the proximate retention finger is positioned slightly more inward of a respective compartment than the stop element. Typically, the closest surface of a stop element may be set back several thousandths of an inch from the end of a compartment defined by a respective retention finger. In this way, the retention finger normally serves to define an end limit to a particular compartment, yet in the event of a sudden shock to the dispenser 10, as by contacting a floor following a drop, the cartridges therein may urge the yieldable retention finger forward somewhat but are ultimately limited in their movement by eventual contact with the ridged stop elements. Thus the stop elements prevent a cartridge from deflecting a retention finger far enough to permit release of the cartridge in those circumstances.

It will be appreciated that by making the yieldable retention fingers free-standing and positioning them to be the sole determinant of an end of a compartment such that the compartment is effectively independent of the compartments on either side thereof, cartridges 11 may be relatively easily manually loaded into the dispenser at the time of manufacture and an accumulation of tolerances from longer than nominal cartridges will not act against the next partition wall to interfere with loading and unloading of the cartridges. Although the retention finger 26 associated with compartment 26' is not entirely free-standing, it is substantially so. Moreover, dispenser 10 is normally offered to the consumer without a shaving cartridge 11 being housed in compartment 26', that compartment being reserved for receiving a dummy cartridge or a used cartridge to be released from a razor handle preparatory to loading a first new cartridge contained in compartment 27'. For that reason, the problems of tolerance accumulation or buildup and excessive manual loading force associated with the placement of cartridges 11 in compartments 27'–31' are not of so much concern regarding compartment 26'.

In use, the operator inserts a used cartridge 11 attached to handle 15 into the empty compartment (typically uppermost compartment 26') by almost any downward movement of the razor and cartridge into the compartment. Although such insertion may be facilitated by first loading either the forward or the after end of the cartridge into the compartment first and subsequently rotating the opposite end thereinto, that technique is not essential, and a continuous downward translational movement causing temporary deflectional movement of the retention finger is sufficient. The used shaving cartridge 11 is thus retained in the compartment (i.e., 26') and the handle 15 is free to pick up a new cartridge 11 in the next compartment (i.e., 27'). The now-opened journals 14 on razor handle 15 are moved downward into alignment and subsequently engagement with the journal bearings 12 in a new cartridge 11 preparatory to its removal from its respective compartment in the dispenser 10. The handle is then rotated upwardly or counterclockwise as viewed in FIG. 3, camming the guard surface at the right-hand end of cartridge 11 along the opposing cam surface of the adjacent partition and yieldably flexing the respective retention finger at the opposite end thereof to remove the blade cartridge from the compartment. Because the handle 15 and cartridge 11 are permitted to limitedly pivot relative to one another, the handle may be required to undergo a greater angular deflection than that of the cartridge to effect the removal.

Figure 7:
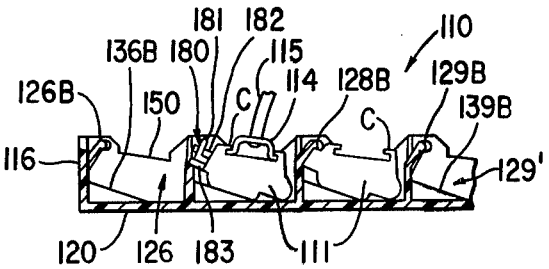
FIG. 7 is an elevational sectional view of a portion of the dispenser of FIG. 6 taken along line 7—7 thereof.
Figure 8:
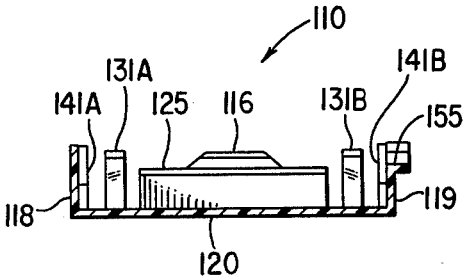
FIG. 8 is an elevational sectional view of the dispenser of FIG. 6 taken along line 8—8 thereof.
Figure 9:
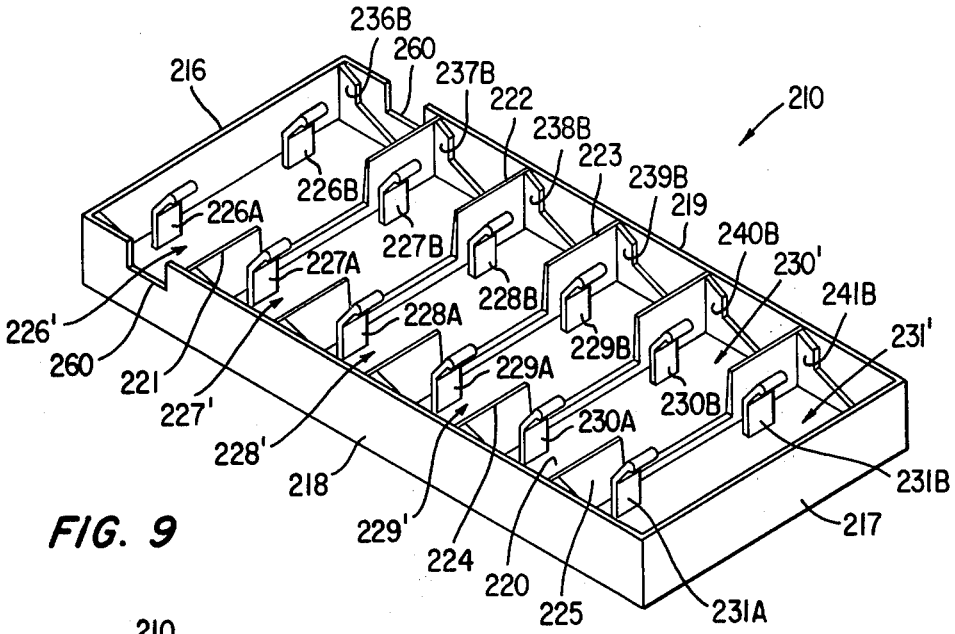
FIG. 9 is a perspective view of a dispenser in accordance with a further embodiment of the invention.

Another embodiment is illustrated in FIGS. 5–8. The dispenser 110 of this embodiment is designed for use with a blade cartridge 111 of the type disclosed in U.S. patent application Ser. No. 866,127 filed Dec. 30, 1977, in the name of Evan N. Chen et al for IMPROVED CLEAN-OUT MECHANISM FOR TWIN BLADE SHAVING UNIT and U.S. Design patent application Ser. No. 866,146 filed Dec. 30, 1977, in the name of Evan N. Chen for SAFETY RAZOR CARTRIDGE WITH CLEAN-OUT MECHANISM. The blade cartridge 111, in addition to including journal bearings 112 for pivotal connection with a pivoting razor, also includes the more conventional T-shaped channel C of the prior art cartridges disclosed in the aforementioned U.S. Pat. Nos. 3,785,051 and 3,835,532. A conventional razor handle 115 having a U-shaped channel member 114 is illustrated in FIG. 7 as being operatively connected with a blade cartridge 111. Cartridge 111, in addition to providing for connection with different types of razors, also provides a manually displaceable clean-out mechanism 180 having an actuating portion extending rearwardly out of the cartridge and including push tab 181 disposed normal thereto for actuation. In order to house a portion of this clean-out mechanism, the rearward portion of cartridge 111 is provided with an arcuate housing comprising rearwardly extending portions 182 and 183 of the seat and cap respectively of cartridge 111.

The dispenser 110 of the FIGS. 5–8 embodiment is similar to the FIGS. 1–4 dispenser embodiment in that it is a one-piece molded structure of a suitable plastic such as high impact polystyrene including a pair of opposing end walls 116, 117 and a pair of opposing side walls 118, 119, all of which are upstanding from a base 120. Further, the side and end walls 116–119 are joined at their ends in rectangular configuration and together comprise a peripheral wall for base 120, also of rectangular shape in plan view. Also forming an integral part of dispenser 110 are transverse partition walls 121–125 upstanding from base 120 and retention fingers 126A, 126B–131A, 131B also upstanding from base 120. The transverse partition walls 121–125 as well as end walls 116, 117 and the retention fingers 126A, 126B–131A,

131B serve to form a series of six chambers or compartments 126'-131'. Similar to the above embodiment, each compartment is defined by a transverse wall at one end and now by a pair of retention fingers at the other end. The sides of the respective compartments 126'-131' are defined by portions of the dispenser side walls 118, 119.

The present embodiment differs from the FIGS. 1-4 embodiment in that the partition walls 121-125 are each singular continuous members extending transversely of dispenser 110 and spaced at opposite ends thereof from the respective sides of the dispenser. Also, rather than a singular centrally placed retention finger defining one end of each compartment, the present embodiment provides a pair of free-standing fingers, i.e., 127A, 127B, respectively positioned between the opposite ends of a partition wall, i.e., 121, and the respective side walls 118, 119 of the dispenser.

The transverse partition walls 121-125 are shorter than the previous embodiment, being only about 0.2 inches high. Additionally, the tops of partition walls 121-125 are sloped downwardly slightly toward the proximate compartment adjacent that for which the respective partition wall forms an end wall. For example, the top surface of partition wall 121 slopes downwardly slightly toward compartment 127' to provide a partial vertical support for the cartridge therein. End wall 116 is similar to partition walls 121-125 except that it is heightened at the center to the same height as the opposing end wall 117 for proper engagement with a razor tray (not shown). The thickness of these partition walls 117 and 121-125 narrows from bottom to top, being about 0.060 inch at the root and about 0.040 inch near the top with the compartment-defining surface being inclined to provide that configuration. The width of walls 121-125 and end wall 116 is about one inch.

The opposite end of each compartment 126'-131' is defined by a pair of free-standing flexible retention fingers 126A, 126B-131A, 131B respectively. Each retention finger 126A, 126B-131A, 131B is less than about 0.04 inch thick, has a width of about 0.1 inch and includes a first lower portion vertically upstanding from base 120 to a height of about 0.2 inch and a second portion extending upwardly another 0.1 inch from the first portion and angled inwardly to the compartment which it defines. More specifically, the compartment-facing inner surface of the second portion of a retention finger includes a first surface inclined inwardly about 55° to the vertical and a terminal surface being inclined about 80° to the vertical, or nearly horizontal. This terminal surface is particularly suited for vertically capturing a cartridge within a respective compartment, as illustrated in compartment 128' in FIG. 7. Additionally, the upper portion of each retention finger is twisted or rotated slightly such that its compartment-facing surfaces are not parallel to the opposing partition wall but rather are inclined inwardly somewhat toward the longitudinal centerline of the dispenser. This orientation of the upper portions of the retention fingers is done to accommodate the arcuate rearward extenstions 182, 183 of a cartridge 111 such that those cartridge-embracing surfaces of the respective retention fingers are substantially parallel to the contour of the cartridge 111 thereat.

In the FIGS. 5-8 embodiment, combined cartridge support ramps and stop elements 136A, 136B-141A, 141B are provided at the opposite sides of compartments 126'-131' respectively. Each combined dispenser support ramp and stop element is rigidly and directly connected to dispenser base 120 and the adjacent side walls 118 or 119. Although the compartment-facing lower portion of each pair of retention fingers is substantially coplanar with the partition wall adjacent thereto which defines an end wall of the next adjacent compartment, that pair of retention fingers is positioned longitudinally slightly more inwardly of a respective compartment than the respective pair of stop elements associated therewith. Typically the closest surface of a stop element may be set back several thousandths of an inch from the end of a compartment defined by a respective pair of retention fingers for the purpose hereinbefore described. Although the partition wall proximate a pair of retention fingers is nearly coplanar therewith, a cartridge 111 housed in the compartment having an end defined by that pair of retention fingers does not rely upon that partition wall for longitudinal, or end, support. Instead, that partition wall substantially only provides vertical support to the rearwardly extending arcuate projection 181, 182 of a cartridge extending partially thereover as seen in compartment 127' of FIG. 7. Similarly, the compartment-defining surface of each partition wall is offset slightly, i.e., several thousandths of an inch, from the back surface of the retention fingers of the next adjacent compartment such that a cartridge may contact that partition wall without contacting those retention fingers. As before, one end of each compartment is defined by a substantially rigid partition wall and the other end is defined substantially only by free-standing yieldable retention means for permitting relatively easy manual loading of cartridges into the dispenser and avoiding interference problems created by a longitudinal accumulation of cartridge 111 tolerances greater than nominal.

Side wall 119 of dispenser 110 is provided with a series of six recesses 150-155, each recess being associated with a respective compartment 126'-131' respectively. These recess 150-155 are provided for transverse sliding entry and egress of the U-shaped channel 114 on razor 115 for the respective loading and unloading of a cartridge 111 from the razor. Orientation and feeding of the dispenser 110 preparatory to the loading of blade cartridges thereinto is facilitated by a notch 160 in side wall 118 opposite notch 150 in side wall 119 and acting in cooperation therewith.

A further embodiment is illustrated in FIGS. 9-12. The dispenser 210 of this embodiment is designed for use with a blade cartridge 211 of the type disclosed in U.S. patent application Ser. No. 886,710 filed Mar. 15, 1978, in the name of Evan N. Chen et al for IMPROVED CLEAN-OUT DEVICE FOR TWIN BLADE SHAVING UNIT and U.S. Design patent application Ser. No. 886,711 filed Mar. 15, 1978, in the name of Evan N. Chen for SAFETY RAZOR CARTRIDGE WITH CLEAN-OUT DEVICE. The blade cartridge 211 includes journal bearings 212 for pivotal connection with a pivoting razor 215 having journals 214 in the manner of the FIGS. 1-4 embodiment. Cartridge 211 also provides a manually displaceable clean-out mechanism 280 having an actuating portion extending rearwardly out of the cartridge and including a push tab 281 for actuation. Unlike the cartridge 111 of the FIGS. 5-8 embodiment, no arcuate housing for the clean-out mechanism 280 extends rearwardly from cartridge 211. Instead, the rear end of a blade cartridge 211 is substantially parallel the forward or guard end thereof such that the cartridge exclusive of the clean-out mechanism 280 has a reduced dimension from front to rear relative to the cartridge 112. Orientation and feeding of dispenser 210 during assembly is facilitated by opposite notches 260 in side walls 218, 219.

Dispenser 210 of the FIGS. 9–12 embodiment is similar to the FIGS. 1–4 and FIGS. 5–8 embodiments in that it is a one-piece molded structure of a suitable plastic such as high impact polystyrene including a pair of opposing end walls 216, 217 and a pair of opposing side walls 218, 219, all of which are upstanding from a base 220. Further, the side and end walls 216–219 are joined at their ends in rectangular configuration and together comprise a peripheral wall for base 220, also of rectangular shape in plan view. Also forming an integral part of dispenser 210 are transverse partition walls 221–225 upstanding from base 220 and retention fingers 226A, 226B–231A, 231B also upstanding from base 220. The transverse partition walls 221–225 as well as end walls 216, 217 and the retention fingers 226A, 226B–231A, 231B serve to form a series of six chambers or compartments 226'–231'. Similar to the FIGS. 5–8 embodiment, each compartment is defined by a transverse wall at one end and by a pair of retention fingers at the other end. The sides of the respective compartments 226'–231' are defined by portions of the dispenser side walls 218, 219.

In the present embodiment, partition walls 221–225 are each singular substantially continuous members extending transversely the full width of dispenser 110 and connected to the respective opposite sides thereof. Each partition wall 211–225 extends upwardly from base 220 about 0.3 inch and includes a cut-out portion or notch in the central one-third thereof extending downwardly from the top edge to about 0.06 inch from base 220. This notch is sufficiently deep and wide to clear clean-out mechanism push tab 281 if such is necessary, yet the remaining base portion of the partition wall thereat is sufficient to contribute to the rigidity of the partition wall as a whole. The partition walls 221–225 are slightly thicker at their base, i.e., 0.04 inch, than at their top, i.e., about 0.03 inch. On the compartment-facing side of each partition all 221–225 there are additionally integrally molded a transversely spaced vertically extending pair of contact pads 261A, 261B–266A, 266B respectively. Each pair of contact pads comprises an integral portion of the respective partition wall and has a thickness longitudinally of the dispenser 210 of about 0.15 inch such as to define the compartment-end defining portions of the respective partition wall. Each of the contact pads 261A, 261B–266A, 266B has a compartment-facing surface which is substantially vertical for the first half, or about 0.125 inch, of its height and which is relieved by being inclined toward the respective partition wall over the remaining upper portion, or 0.125 inch, of its height. The relief provided by the inclined surface is to prevent the rear end of cartridge 211 from overstressing respective retention fingers when the guard end of the cartridge is being cammed over the contact pads during entry and egress. Each pair of free-standing fingers, i.e., 227A, 227B defining one end of a respective compartment, i.e., 127', are transversely spaced from the respective opposite side walls 218, 219 of the dispenser and are additionally longitudinally spaced from the proximate partition wall, i.e., 211, of the next adjacent compartment, i.e., 226'. Fingers 226A–231A are spaced about one-fourth the width of dispenser 210 from side wall 218, and retention fingers 226B–231B are spaced the same distance from the opposite side wall 219. This spacing permits sufficient clearance for the push tab 281 of the clean-out mechanism associated with a respective cartridge. Each retention finger 226A, 226B–231A, 231B is less than about 0.04 inch thick, has a width of about 0.185 inch and includes a first vertical lower portion upstanding from base 220 to a height of about 0.175 inch and a second portion extending upwardly another 0.085 inch from the first portion and angled inwardly to the compartment which it defines. More specifically, the compartment-facing inner surface of the second portion of a retention finger includes a first surface inclined inwardly about 35° to the vertical and a terminal surface being inclined about 80° to the vertical, or nearly horizontal. This terminal surface is particularly suited for vertically capturing a cartridge within a respective compartment, as illustrated in compartment 228' in FIG. 11. Inasmuch as the rear edge of a cartridge 211 is essentially linear and perpendicular to the dispenser side walls 218, 129, the cartridge-retaining surface of the retention finger are also substantially perpendicular to the dispenser side walls.

In the FIGS. 9–12 embodiment, combined cartridge support ramps and stop elements 236A, 236B–241A, 241B are provided at the opposite sides of compartments 226'–231' respectively. Each combined cartridge support ramp and stop element is rigidly and directly connected to dispenser base 220 and the adjacent side wall 118 or 119. Each pair of retention fingers defining an end of a compartment is positioned longitudinally slightly more inwardly of the respective compartment than the respective pair of stop elements associated therewith. Typically the innermost surface of a stop element may be set back several thousandths of an inch from the end of a compartment defined by a respective pair of retention fingers.

Figure 10:
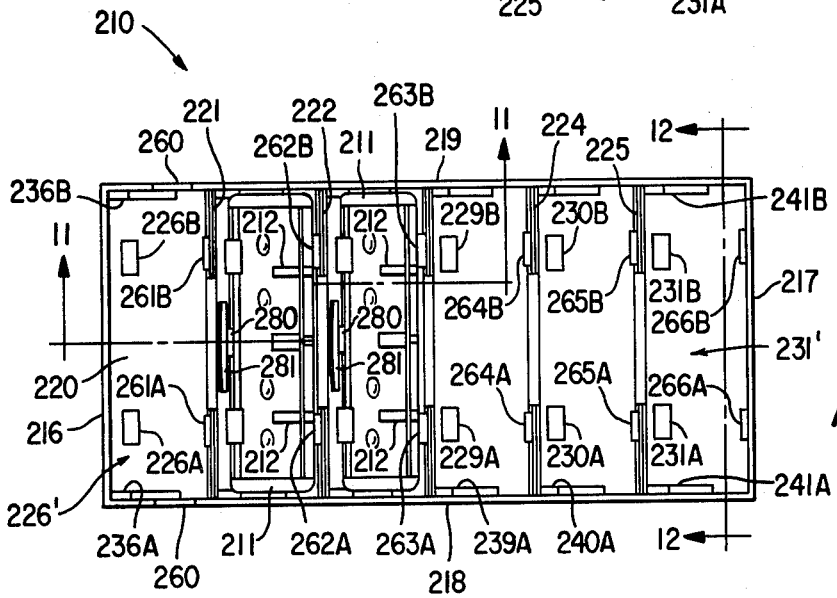
FIG. 10 is a top plan view of the dispenser of FIG. 9 showing blade cartridges therein.
Figure 11:
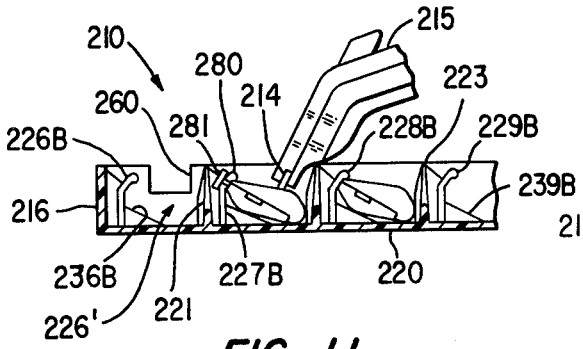
FIG. 11 is an elevational sectional view of a portion of the dispenser of FIG. 10 taken along line 11—11 thereof.
Figure 12:
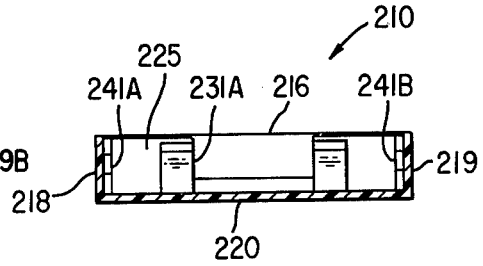
FIG. 12 is an elevational sectional view of the dispenser of FIG. 10 taken along line 12—12 thereof.

As seen in FIGS. 10 and 11, the clean-out mechanism 280 and its push tab 281 in no way contact the partition wall of a next adjacent compartment but rather may terminate just short of the plane of that partition wall and in any event are afforded clearance by the central slot in that partition wall. Accordingly, one end of each compartment is defined by a substantially rigid partition wall and the other end is defined substantially only by free-standing yieldable retention means for permitting relatively easy manual loading of cartridges into the dispenser and avoiding interference problems created by an accumulation of cartridge 111 tolerances greater than nominal longitudinally of dispenser 210.

The loading of shaving cartridges 211 into dispenser 210, either directly by hand or with the aid of a razor, and their subsequent removal therefrom using a razor 215 is substantially identical to the operation described in conjunction with the embodiment of FIGS. 1–4 and will not be repeated hereat.

The invention may be embodied in yet other specific forms without departing from the spirit or essential characteristics thereof. For instance, the particular dispenser embodiments disclosed are not necessarily restricted to housing only the shaving cartridges actually disclosed therewith. Further, more than two retention fingers might be used for each compartment and the partition wall might be segmented somewhat more than disclosed. Thus, the present embodiments are to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A dispenser for a plurality of razor blade cartridges arrayed in a row, said cartridges being normally housed in said dispenser so as to expose means thereon for connecting engagement with a holder for removal from the dispenser, said dispenser comprising:

base means, a peripheral wall upstanding from said base means, a plurality of spaced partition walls within said peripheral wall and upstanding from said base means, said partition walls being disposed parallel to one another and substantially parallel to portions of said peripheral wall to each define only one respective end of a respective series of generally rectangular open-top compartments disposed in a row, the opposite end of each compartment being defined by respective substantially free-standing, yieldable retention means upstanding from said base means, and the side walls of said compartments being defined by portions of said peripheral wall, a said cartridge being retained in a respective said open-top compartment by a respective said retention means acting in cooperation with a respective said partition wall in opposed relation therewith.

2. The dispenser of claim 1 wherein said opposite end of each said compartment is defined only by respective said substantially free-standing yieldable retention means.

3. The dispenser of claim 2 wherein said retention means for each said compartment is connected directly only to said base means, thereby to be free-standing relative to the said partition wall of the next adjacent compartment.

4. The dispenser of claim 2 wherein said retention means defining a said opposite end of a compartment comprises at least one finger-like projection connected directly to said base and extending upwardly therefrom for a first portion of its length and being curved generally into said compartment for a second portion of its length, said first portion of a said projection serving to define said opposite end of a compartment in a direction parallel said base and said second portion generally serving to yieldably latch a dispenser in a compartment normal to the base.

5. The dispenser of claim 2 wherein said base means, peripheral wall, partition walls and retention means are integrally formed as a one-piece plastic structure.

6. The dispenser of claim 2 further including substantially rigid stop means separate from said retention means for limiting displacement of a cartridge in the direction of the next adjacent compartment as a result of shock forces.

7. The dispenser of claim 6 wherein said stop means is directly connected to the partition wall of the next adjacent compartment.

8. The dispenser of claim 6 wherein said stop means is directly connected to a portion of said peripheral wall.

9. The dispenser of claim 4 wherein the number of said finger-like projections forming said retention means in each said compartment is two.

10. The dispenser of claim 9 wherein said base means is rectangular and said peripheral wall includes two opposite end portions and two opposite side portions, each said partition wall extends continuously from one said side portion to the other of said peripheral wall, a central notch being formed in the upper portion of each said partition wall to clear an appendage on a cartridge in the next adjacent compartment, and said two finger-like projections defining an end of said next adjacent compartment being on laterally opposite sides of said notch and spaced longitudinally from said partition wall toward said next adjacent compartment.

11. The dispenser of claim 9 wherein said base means is rectangular and said peripheral wall includes two opposite end portions and two opposite side portions, each said partition wall extends normal to but is spaced from said opposite side portions of said peripheral wall centrally therebetween, the vertical extent of each said partition being limited to clear an appendage on a cartridge in the next adjacent compartment, and said two finger-like projections defining an end of the next adjacent compartment being on laterally opposite sides of said partition wall and spaced longitudinally from said partition wall toward said next adjacent compartment.

* * * * *